US005769241A

United States Patent [19]

Woodgate

[11] Patent Number: 5,769,241

[45] Date of Patent: Jun. 23, 1998

[54] SCREEN PANEL FIXING SYSTEM

[75] Inventor: Raymond Maxwell Woodgate, Melton South, Australia

[73] Assignee: Lettela Pty Ltd, Victoria, Australia

[21] Appl. No.: 545,557

[22] Filed: Oct. 19, 1995

[30] Foreign Application Priority Data

Oct. 19, 1994 [AU] Australia ..... PM8885

[51] Int. Cl.[6] ..... B07B 1/49

[52] U.S. Cl. ..... 209/399; 209/405; 209/408

[58] Field of Search ..... 209/397, 399, 209/403, 405, 409, 412, 408

[56] References Cited

U.S. PATENT DOCUMENTS

| | | | |
|---|---|---|---|
| 721,875 | 3/1903 | Farnsworth . | |
| 766,150 | 7/1904 | Lovejoy . | |
| 918,261 | 4/1909 | Bayley . | |
| 2,345,364 | 3/1944 | Spafford . | |
| 4,909,929 | 3/1990 | Tabor . | |
| 5,112,475 | 5/1992 | Henry, Jr. | 209/399 |
| 5,361,911 | 11/1994 | Waites, Sr. et al. | 209/405 X |

FOREIGN PATENT DOCUMENTS

| | | | |
|---|---|---|---|
| A-47137/89 | 7/1990 | Australia . | |
| B-80171/91 | 9/1993 | Australia . | |
| B-46121/93 | 10/1994 | Australia . | |
| 0 470 422 A2 | 2/1992 | European Pat. Off. . | |
| 567361 | 10/1993 | European Pat. Off. | 209/399 |
| 1237448 | 10/1958 | France . | |
| 1178881 | 5/1959 | France . | |
| 317512 | 12/1919 | Germany . | |
| 435328 | 9/1935 | United Kingdom . | |

OTHER PUBLICATIONS

"How Fast Can You Change Your Screen Decks?", Conn. Weld Industries Inc., Princeton, West Virginia; published in *Coal*, Sep. 1991.

*Primary Examiner*—William E. Terrell
*Assistant Examiner*—Tuan N. Nguyen
*Attorney, Agent, or Firm*—Merchant, Gould, Smith, Edell, Welter & Schmidt, P.A.

[57] ABSTRACT

A system for fixing screen panels to a screen deck frame of an ore screening apparatus. An elongate fixing rail extends over the screen deck frame along and between side edge regions of a pair of adjacent screen panels. The fixing rail, in use, is non-interconnecting with the screen panels. An elongate retaining strip extends along the fixing rail, and engages the side edge regions of the screen panels in an overlying relationship. The retaining strip is connectable to the fixing rail so that the retaining strip secures the screen panels in position against upward movement away from the screen deck frame.

16 Claims, 1 Drawing Sheet

SCREEN PANEL FIXING SYSTEM

FIELD OF THE INVENTION

This invention relates generally to apparatus for screening, separating or grading materials, and in particular to a system to fixing screen panels to a support frame of such apparatus. The apparatus is applicable for screening, separating and grading ores and other materials, and it will be convenient to hereinafter describe the invention in relation to that exemplary application. It is to be appreciated, however, that the invention is not limited to such apparatus.

BACKGROUND OF THE INVENTION

A variety of systems have been developed for fixing screen panels to a support frame whereby individual panels can be easily and rapidly removed and replaced when worn. One system used for fixing adjacent screen panels along opposed side edge regions to a support frame is disclosed in Australian patent 654091. The system of that patent provides an elongate U-shaped fixing member for securing to the support frame so as to extend longitudinally between side edge regions of adjacent screen panels. The fixing member has a pair of connection portions, with connection elements being provided along the outer side surfaces of the connection portions and the side edge faces of the screen panels. The connection elements of each connection portion and an associated screen panel interengage to hold the screen panels in position on the support frame. The connection portions are inwardly deflectable away from the side edge faces in order to disengage the connection elements and disconnect the screen panels from the fixing member. A retaining member is provided for extending along the fixing member in engagement with the connection portions to resist their inadvertent deflection, and thus maintain engagement between the connection elements.

This fixing system performs generally satisfactorily. However, one disadvantage is the relatively complex configuration of the outer side surfaces of the connection portions and the side edge faces of the screen panels provided by the connection elements. That complexity can add to the cost of production of the screen panels. In addition, those connection elements can sometimes be susceptible to dirt accumulation during use and/or storage. That accumulation requires removal before complete and proper interengagement of the connection elements can be achieved during screen panel installation, in turn leading to delays or difficulties with that installation.

SUMMARY OF THE INVENTION

It is an object of the present invention to provide a fixing system with a simplified screen panel fixing facility which alleviates the above disadvantages.

A further object of the present invention is the provision of a screening apparatus incorporating the improved fixing apparatus.

With these objects in mind, the present invention provides in one aspect a system for fixing screen panels to a screen deck frame of an ore screening apparatus, including: an elongate fixing member arranged to extend over the screen deck frame along and between opposed side edge regions of a pair of adjacent screen panels, for fixing members, in use, noninterconnecting with the adjacent screen panels; an elongate retaining member arranged to extend along the fixing member and engage the side edge regions of the adjacent screen panels in overlying relationship therewith, the retaining member being connectable to the fixing member whereby the retaining member secures, the screen panels in position against upward movement away from the screen deck frame.

In another aspect the present invention provides an ore screening apparatus including: a screen deck frame having a sub-frame structure; an array of screen panels on the screen deck frame to form a continuous screen deck; and, a-fixing system fixing the screen panels to the screen deck frame, the fixing system having elongate fixing members arranged on the sub frame structure in parallel spaced apart rows so as to extend along and between opposed side edge regions of respective pairs of adjacent screen panels, the fixing members noninterconnecting with the screen panels, and elongate retaining members arranged to extend along the fixing members and engage the side edge regions of the adjacent screen panels in overlying relationship therewith, the retaining members being connected to the fixing members whereby the retaining members secure the screen panels in position against upward movement away from the screen deck frame.

This invention is described herein with reference to the fixing system in a normal apparatus use orientation on a horizontally extending screen deck frame, and terms such as "above", "upward" and "downward" should be construed in the light of this orientation. However, it is to be appreciated that other orientations may be equally possible and that consequential changes in terms such as those above may be required in the light of those other orientations for a proper and complete understanding of the invention.

In the fixing system of the present invention, the fixing member has no more than limited contacting engagement with the adjacent screen panels, and in particular does not have an interconnecting or interlocking relationship therewith. Thus, in one embodiment the fixing member is in closely spaced apart side-by-side relation with the screen panels, so that the fixing member and side edge regions of the screen panels are out of contact in an alternative embodiment, the fixing member contacts the screen panels in frictional engagement, This contact is preferred to enable positive and precise location of the screen panels on the screen deck frame relative to the fixing system. In both embodiments, however, there is an absence of positive or substantial interconnection between the fixing member and screen panels, such as with cooperable connection means as in prior Australian patent 654091. Thus, in these embodiments the fixing member does not of itself cooperate with the screen panels to provide any significant or substantial fixing of the screen panels against upward movement away from the screen deck frame. That fixing is provided by the retaining member in the present invention. In at least one preferred embodiment, the screen panels are fixed against upward movement solely by the retaining member.

Preferably, the fixing member has a pair of longitudinally extending, side edge faces. Those side edge faces are planar and, in use, extend in face-to-face, non-interconnecting relation with respective planar side edge faces of the Screen panels. The fixing member preferably has spaced apart and top and base surfaces, and the side edge faces of the fixing member each extend between the top and base surfaces. In at least one preferred embodiment, the side edge faces are wholly flat between the top and base surfaces and along the extent of the fixing member. The side edge faces of the fixing member preferably extend at least substantially parallel with one another.

Preferably, the retaining member has at least one pair of longitudinally extending retaining faces Those retaining faces are preferably arranged for engagement upon the side edge regions of the respective screen panels to secure the screen panels in position. The retaining member preferably projects laterally beyond the underlying fixing member, and the pair of retaining faces face downwardly for engagement with the side edge regions of the respective adjacent screen panels so as to securely retain the screen panels between those retaining faces and the screen deck frame.

The retaining member preferably includes a cover portion. In fixing system use, that cover portion is positioned above the adjacent screen panels and provides one pair of the downwardly facing retaining faces. Each retaining face is arranged for downward bearing engagement upon an upper screening surface of the adjacent screen panels.

The retaining member includes a locating portion as an alternative to or in addition to the cover portion. In fixing system use, that locating portion is positioned between the adjacent screen panels beneath the upper screening surface, and provides one pair of downwardly facing retaining faces thereon. Each retaining face is arranged for downward bearing engagement upon upwardly facing bearing faces formed in the side edge regions of the adjacent screen panels.

Preferably, the fixing rail is sized so that its top surface is located below the upper screening surface of the adjacent screen panels. As a result a locating channel is defined above the fixing rail and between the adjacent screen panels. The locating portion is received in a respective locating channel. The side edge regions of the screen panels adjacent the locating channel are preferably laterally stepped between the upper screen surface and a lower surface of the screen panels. That provides stepped side edge faces on the screen panels and forms the upwardly facing bearing faces upon which the downwardly facing retaining faces on the locating portion bears.

Where both the cover portion and locating portion are provided, the retaining member is preferably laterally stepped between the pairs of retaining faces. The retaining faces on the cover portion are located laterally outwardly of and above the retaining faces on the locating portion, Preferably, the fixing and retaining members have cooperable connection means for interconnection. The connection means preferably includes connection elements on the fixing and retaining members which are releasably interengageable to secure the fixing and retaining members together and secure the screen panels in position. In at least one preferred embodiment, the connection elements include at least one connection plug and socket The connection plug is on one of the fixing member or retaining member, and is receivable in the socket in the other one of the fixing member or retaining member.

The following description refers to a preferred embodiment of the fixing system and apparatus of the present invention. To facilitate an understanding of the invention, reference is made in the description to the accompanying drawings where the fixing system and apparatus are illustrated in that preferred embodiment. It is to be understood that the fixing system apparatus are not limited to the preferred embodiment as hereinafter described and as illustrated in the drawings.

DESCRIPTION OF THE PREFERRED EMBODIMENT

Figure 1:
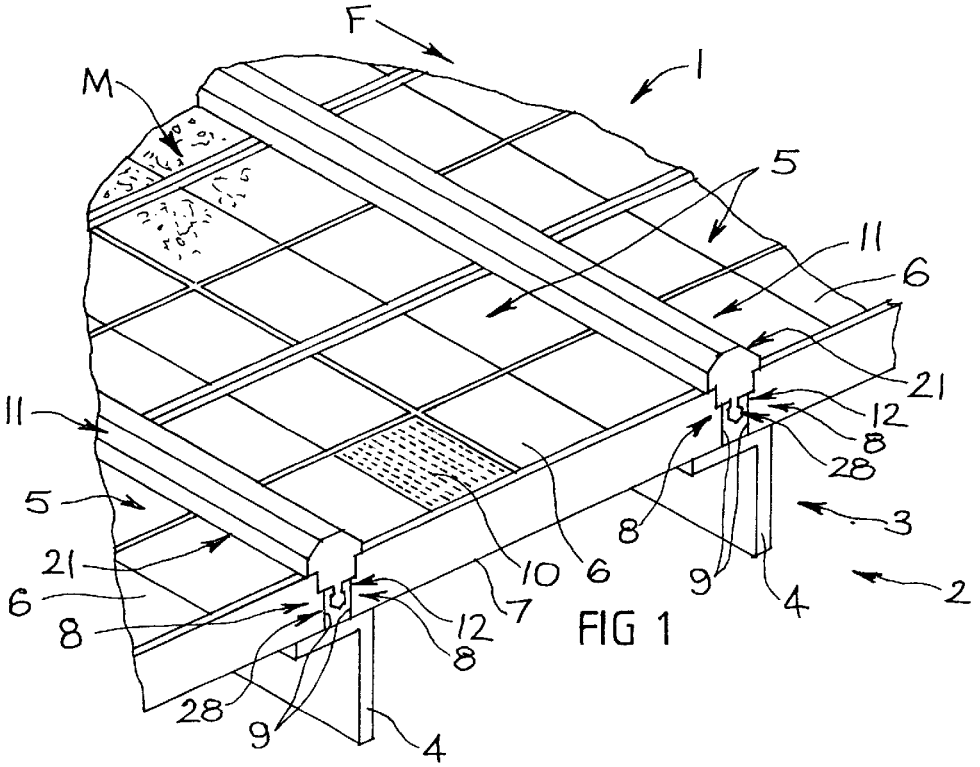
FIG. 1 is a perspective view of part of an ore screening apparatus incorporating a screen panel fixing system according to a preferred embodiment of the present invention.

Referring initially to FIG. 1 of the drawings there is generally shown an ore screening apparatus 1 for screening, separating and grading ores and other materials M. Materials M move through the apparatus 1 during screening in the direction of feed arrow F.

The apparatus 1 includes a screen deck frame 2 which has an elongate sub-frame structure 3 comprising parallel, spaced apart sub-frame support beams 4 extending along the apparatus 1. An array of screen panels 5 are fixed to, and supported by, the screen deck frame 2 to form the continuous screen deck. Each screen panel 5 extends between and is supported by a pair of the support beams 4. Each screen panel 5 is typically flat, and square or rectangular plan shape, with an upper screening surface 6 for receiving ore or other material Ml to be screened and a lower bearing surface 7 that bears on the support beams 4. Each screen panel 5 has a pair of opposed side edge regions 8 with side edge faces 9. Apertures 10 extend through the screen panels 5 between the screening and bearing surfaces 6, 7 to provide for ore screening and separation.

The screen panels 5 are cast or molded from plastics material, such as polyurethane, and may be internally reinforced with one or more metal elements, such as steel bars (not shown). It should be appreciated that alternative materials and methods of production may be equally suitable.

The apparatus 1 provides a fixing system 11 for releasably fixing the screen panels 5 to the screen deck frame 2, and in particular the sub-frame structure 3.

The fixing system 11, in this embodiment of the present invention includes a plurality of fixing members 12 which, in this embodiment, are in the form of elongate fixing rails. Each fixing rail 12 extends along a respective support beam 4 so that the fixing rails 12 are in parallel spaced apart relation and positioned between adjacent screen panels 5.

Figure 3:
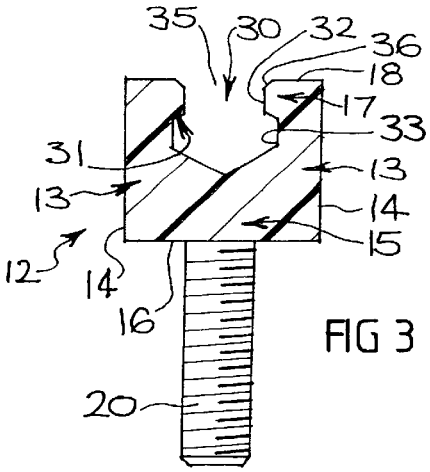
FIG. 3 is an end view of a fixing rail of the fixing system of FIG. 1.

One fixing rail 12 is shown in detail in FIG. 3, and includes a pair of longitudinal side edge regions 13 which, in use, extend side-by-side with respective side edge regions 8 of adjacent screen panels 5. Those side edge regions 13 each have a side edge face 14 which is arranged in face-to-face relation with respective side edge faces 9 of the screen panels 5. The fixing rails 12 extend at least substantially entirely along the screen panels 5 with the side faces 9,14 in side-by-side relation throughout that extent.

The side edge faces 9,14 are at least substantially flat and planar to enable face-to-face spacing or contact between the fixing rail 12 and screen panels 5. Thus, the side edge faces 9,14 do not incorporate configurations, such as grooves and ribs, enabling interconnecting engagement therebetween.

In this embodiment, the side edge faces 14 of the fixing rails 12 and screen panels 5 are planar and extend at least substantially parallel with one another. Those planes all extend perpendicular to a general plane of the screen panels 5, in this embodiment. It is envisaged that in an alternative embodiment (not Shown) one or more of the side edge faces 9,14 may extend in planes at angles other than perpendicular to the screen panel plane. Thus, those side edge faces 9,14 may extend in upward planes angled inwardly over the fixing rail 12 or outwardly away from the fixing rail 12.

In this embodiment each fixing rail 12 also includes a base portion 15 having a base surface 16 through which the rail 12 bears on a screen deck frame 2, and a top portion 17 having a top surface 18. The side edge faces 14 extend between the base and top surfaces 16,18. In this embodiment, each fixing rail 12 has a generally square or rectangular sectional profile, and is sized so as to fit neatly between adjacent screen panels 5, preferably with interfering contact between the side faces 9,14 thereof.

In one embodiment (not shown), the top surface 18 of the fixing rail 12 lies flush with the upper screening surface 6 of the screen panels 5. In an alternative embodiment (as shown particularly in FIG. 4), the fixing rail 12 is sized so that its top surface 18 is located below the upper screening surface 6 of the screen panels S. Thus, a locating channel 19 is defined between the screen panels 5 above the fixing rail 12. This may be achieved with a fixing rail 12 of a height which is less than the thickness of the adjacent screen panels 5.

The fixing rails 12 are mounted on the screen deck frame 2 through any suitable arrangement. To that end, in this embodiment, the rails 12 are bolted to the underlying support beams 4 of the screen deck frame 2. Bolts 20 may be incorporated into the fixing rail 12 during its manufacture, or bolt holes. (not shown) provided in the fixing rail to receive bolts, for bolting of the rail 12 to the support beams 4.

Each fixing rail 12 is of unitary construction, being cast or moulded from plastics material, such as polyurethane, with metal mounting bolts 20 being partially embedded into the rail 12 during moulding. It should be appreciated that alternative materials and methods of production may be equally suitable.

Returning to FIG. 1, the fixing system 11 also includes a plurality of retaining members 21 extending along the fixing members 12. In this embodiment, the retaining members 21 are in the form of retaining strips. The retaining strips 21 wholly or at least substantially act to hold the adjacent !screen panels 5 in position on the screen deck frame 2. That is achieved by configuring the retaining strips 21 so that, when connected to the fixing rails 12, they project laterally therefrom to overlie the side edge regions 8 of the adjacent screen panels 5. In addition, the retaining strips 21 preferably bear against the side edge regions 8, applying a retaining force to urge the screen panels 5 into position against the underlying screen deck frame 2.

Each retaining strip 21 is arranged to extend at least substantially entirely along a fixing rail 12, and overlie the side edge regions 8 of the adjacent screen panels 5 throughout the extent.

Figure 2:
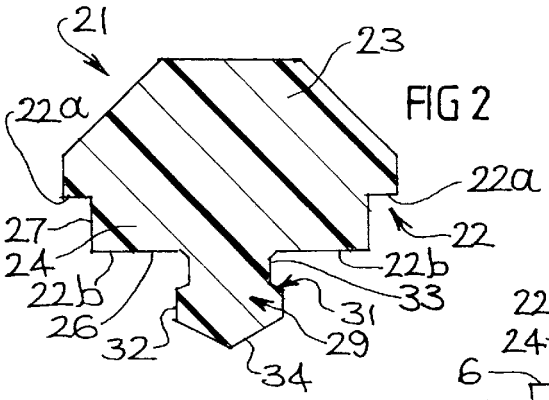
FIG. 2 is an end view of a retaining strip of the fixing system of FIG. 1.

One retaining strip 21 is shown in detail in FIG. 2 and includes at least one pair of underlying retaining faces 22 extending therealong and arranged for engagement with the side edge regions 8 of the respective screen panels 5. Thus, in fixing system use (as shown in FIG. 1) the side edge regions 8 of the screen panels 5 are effectively restrained or held between the retaining faces 22 of the retaining strip 21 and support beams 4.

In this embodiment the retaining strips 21 extend above and overlie the screen panels 5. Each retaining strip 21 includes a cover portion 23 which, in fixing system use, is positioned above the screen panels 5 and provides a pair of the downward facing retaining faces 22*a* each arranged for downward bearing engagement upon the upper screening surface 6 of respective screen panels 5. In this way, the side edge regions 8 are effectively clamped between the overlying retaining faces 22*a* and the underlying screen deck frame 2.

The cover portion 23 extends over joints formed between the fixing rail 12 and screen panels 5 to inhibit ingress of any ore fines or paste therebetween which could wear the fixing rail 12 or screen panel edge regions 8 causing the screen panels 5 to work loose. Full face-to-face bearing contact between the retaining faces 22*a* and upper screening surfaces 6 would enhance the covering ability of the cover portion 23.

In this embodiment, in which locating channels 19 are provided, the retaining strips 21 extend into the channels 19. To that end, each retaining strip 21 includes a locating portion 24 which, in fixing system use, is positioned within the locating channel 19 and provides at least one pair of the downward facing retaining faces 22*b* arranged for downward engagement with respective, generally upward facing, bearing faces 25 formed in the side edge regions 8 of the screen panels 5 within the locating channel 19.

The locating portion 24 has a lower surface 26 extending therealong and providing the or one pair of the underlying retaining faces 22*b* thereon. The lower surface 26 is positioned in face-to-face relation with the top surface 18 of the fixing rail 12, during fixing system use. Those surfaces 26,18 may be in spaced apart or contacting relation when the retaining strip 21 is in its use position.

In this embodiment, the side edge regions 8 of the screen panels 5 are laterally stepped between the upper and lower surfaces 6,7 of the screen panels 5, thereby providing stepped side edge faces 9 and forming the bearing faces 25 in the side edge regions B. That stepping provides a relatively widened locating channel 19 in the spacing between adjacent screen panels 5. Moreover, in this embodiment the stepping is at least substantially perpendicular, so that, the resulting corresponding bearing faces 25 face upward into the channel 19, and the downward facing retaining faces 22*b* of the locating portion 24 extend over the bearing faces 25 for engagement therewith. Each side edge region 8 contains at least one step, providing a corresponding upward facing bearing face 25, in this embodiment Additional steps (not shown) could provide further corresponding bearing faces. The stepping of the side edge regions 8 extends along the entire length of the screen panels 5, so that the bearing faces 25 extend entirely therealong.

In this embodiment, the bearing faces 25 lie substantially flush with the top surface 18 of the fixing rail 12. Moreover, those bearing faces 25 lie in face-to-face relation with the retaining faces 22*b* on the lower surface 26 of the locating portion 24, in fixing system use.

The locating portion 24 has side edge faces 27 extending therealong and which are positioned in face-to-face relation with the side edge faces 9 of the adjacent screen panels 5 during fixing system use. Those side edge faces 27, like those of the fixing rail 12, are at least substantially planar to enable face-to-face spacing or contact between the locating portion 24 and screen panels 5, in this embodiment. Thus, again, these side edge faces 27 do not incorporate configurations, such as grooves and ribs, enabling positive interconnecting engagement therebetween.

The side edge faces 27 of the locating portion 24 are planar, and extend at least substantially parallel with one another and with the side edge faces 9 of the screen panels 5. Thus, in this embodiment, those side edge faces 27 extend perpendicular to the general plane of the screen panels 5.

In this preferred embodiment, the retaining strip 21 is provided with both the cover portion 23 and the locating portion 24, so that there are a total of at least 4 retaining faces 22*a*, 22*b* coacting with the side edge regions 8 to hold the adjacent screen panels 5 in position. Alternative embodiments (not shown) may provide a retaining strip 21 having only the cover portion 23 or the locating portion 24.

In this embodiment, the locating portion 24 depends from the cover portion 23 and extends at least substantially entirely therealong so as to extend into the locating channel 19 along its length Each retaining strip 21 is connectable to a respective fixing rail 12 in any suitable manner. Connection is releasable, in this embodiment, to enable removal and replacement of the screen panels 5.

In this embodiment, the fixing rail 12 and retaining strip 21 have cooperable connection means 28 to achieve their interconnection. The connection means 28 includes connection elements 29,30 on the fixing rail 12 and retaining strip 21, respectively those connection elements 29,30 releasably interengaging to secure the fixing rail 12 and retaining strip 21 together. In this embodiment, those connection elements 29,30 also generate the retaining forces that the retaining strip 21 applies to the screen panels 5 to hold them in position.

Figure 4:
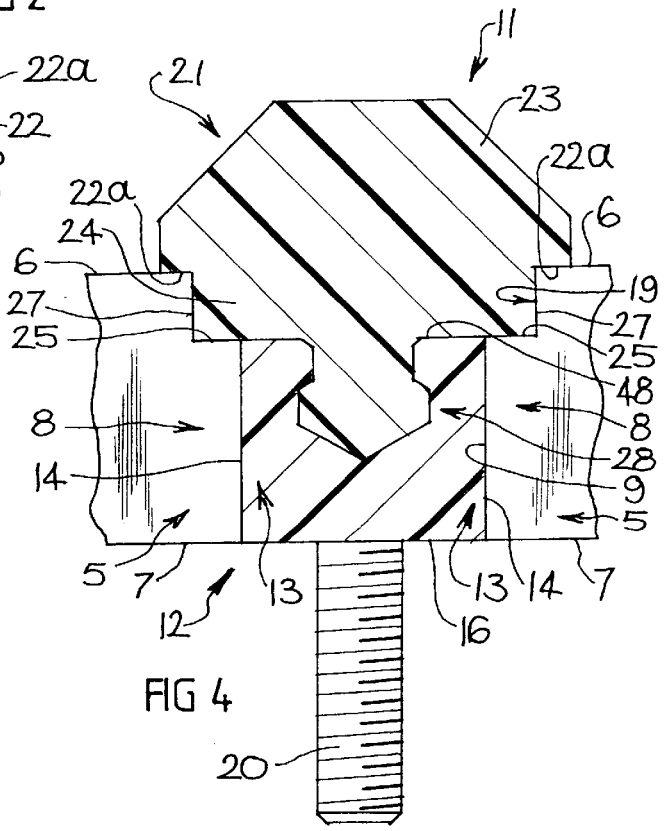
FIG. 4 is an end view of the screen panel fixing system of FIG. 1, assembled together with screen panels.

The connection elements 29,30 include at least one connection plug and socket 29,30, as shown separately in FIGS. 2 and 3 respectively, and interengaged in FIG. 4. In this preferred embodiment, a single rib-like connection plug 29 and a single groove-like connection socket 30 are provided extending at least substantially entirely along a respective one of the retaining strip 21 or fixing rail 12. The plug 29 is located on the retaining strip 21 in this embodiment. In particular, the plug 29 projects from the lower surface 26 of the locating portion 24. In this embodiment, the socket 30 is provided in the fixing rail 12, and in particular opens on to the top surface 18 thereof.

In this embodiment, the connection plug 29 is an interfering fit in the connection socket 30. Retention of the plug 29 in the socket 30 may be further insured by providing cooperable retaining elements 31 on the plug 29 and socket 30. In this embodiment, the retaining elements 31 include one or more cooperable retaining ribs 32 and grooves 33 extending along the surfacer; of the plug 29 and socket 30. Thus, the plug 29 may have an arrow head profile and the socket 30 may be correspondingly profiled to receive that arrow head plug 29. This profiling may also assist in generating retaining forces so that the retaining strip 21 is caused to positively bear upon the screen panels 5 to secure them in position.

In this embodiment, the connection plug 29 and/or socket 30 is configured to facilitate interconnection. In that regard, the plug 29 may have a tapered leading end region 34 and/or the socket 30 may have an opening 35 with a chamfered edge region 36, to facilitate interengagement therebetween.

In this embodiment, the retaining strip 21 is of unitary construction, being cast or moulded from plastics material, such as polyurethane, although it should be appreciated that alternative materials and methods of production may be equally suitable.

In using a preferred embodiment fixing system 11 in ore screening apparatus 1 is outlined above, a series of fixing rails 12 are mounted on support beams 4 of the screen deck frame 2 so a to extend in parallel spaced apart relation along the frame 2. The fixing rails 12 are spaced apart a distance substantially equal to the width of screen panels 5 to be secured with the fixing system 11.

With the retaining strips 21 removed from the rails 12, screen panels 5 are positioned between the rails 12, their side edge faces 9 being in face-to-face contact with respective side edge faces 14 of the rails 12. At this stage, the screen panels 5 are located but not positively secured in position by the rails 12, ie. there is no positive interengagement between the screen panels 5 and rails 12, such as in the fixing system of Australian patent 654091. Thus, at this stage, the screen panels 5 may be simply and easily removed from between the rails 12.

Retaining strips 21 are then fitted into position and connected to the fixing rails 12. Those strips 21 in turn are orientated so as to extend along and overlie a respective fixing rail 12, with the connection plug 29 facing toward the open connection socket 30. The strip 21 is then moved toward the rail 12 causing the plug 29 to enter the connection socket 30 until interconnection between their ribs 32 and grooves 33 secure the strip 21 in position. In this position, the retaining strip 21 overlies the fixing rail 12 and side edge regions 8 of adjacent screen panels 5. The plug and socket connection tends to draw the retaining strip 21 toward the rail 12 so that the retaining forces are brought to bear upon the upper screening surface 6 and bearing faces 25 at the side edge regions 5 of the screen panels 5. That, in turn, forces the screen panels 5 toward the screen deck frame 2 and maintains them in that position.

Removal of a screen panel 5 is generally a reverse of the above outlined installation procedure.

The fixing system of the present invention provides for simple fixing of screen panels into ore screening apparatus. In particular, screen panel fixing is achieved without a requirement for the screen panels to have complex side edge region configurations. Rather, the fixing system achieves satisfactory fixing through simple holding of the screen panel edge regions between the fixing system and apparatus frame.

Finally, it is to be understood that various modifications and/or alterations may be made to the screen panel fixing system without departing from the ambit of the present invention as defined in the claims appended hereto.

I claim:

1. A system for fixing screen panels to a screen deck frame of an ore screening apparatus, each screen panel having an upper screening surface and a pair of opposed side edge regions with an upwardly facing bearing face formed along each side edge region beneath the upper screening surface, the system comprising: an elongate fixing member arranged to extend over the screen deck frame along and between the side edge regions of a pair of adjacent screen panels, the fixing members, in use, non-interconnecting with the adjacent, screen panels; and an elongate retaining member arranged to extend along and connect with the fixing member, the retaining member including a locating portion which, in fixing system use, is positioned between the adjacent screen panels beneath the upper screening surfaces thereof, the locating portion having a pair of downwardly facing retaining faces extending therealong, each said retaining face being arranged for downward bearing engagement upon a respective one of the upwardly facing bearing faces, and a cover portion which, in fixing system use, is positioned above the adjacent screen panels, the cover portion having another pair of downwardly facing retaining faces extending therealong, each said other retaining face being arranged for downward bearing engagement upon a respective one of the upper screening surfaces of the adjacent screen panels, whereby the retaining member secures the screen panels in position against upward movement away from the screen deck frame.

2. A fixing system as claimed in claim 1, wherein the fixing member has a pair of longitudinally extending side edge faces, the side edge faces being substantially planar and, in use, extending in face-to-face, non-interconnecting relation with respective planar side edge faces of the screen panels.

3. A fixing system as claimed in claim 2, wherein the fixing member has spaced apart and top and base surfaces, the side edge faces of the fixing member each extending between the top and base surfaces and being wholly flat between the top and base surfaces and along the extent of the fixing member.

4. A fixing system as claimed in claim 3, wherein the side edge faces of the fixing member extend at least substantially parallel with one another.

5. A fixing system as claimed in claim 3, wherein the fixing member includes a fixing rail providing the side edge faces and the top and base surfaces, the fixing rail being of generally square or rectangular cross sectional profile.

6. A fixing system as claimed in claim 1, wherein the retaining member is laterally stepped between the pairs of retaining faces with the retaining faces on the cover portion being located laterally outwardly of and above the retaining faces on the locating portion.

7. A fixing system as claimed in claim 1, wherein the fixing and retaining members have cooperable connection means for interconnection, the connection means comprising connection elements on the fixing and retaining members which are releasably interengageable to secure the fixing and retaining members together and secure the screen panels in position.

8. A fixing system as claimed in claim 7, wherein the connection elements include at least one connection plug and socket, the connection plug on one) of the fixing member or retaining member being receivable in the socket in the other one of the fixing member or retaining member.

9. A fixing system as claimed in claim 8 wherein a single rib-like connection plug and a single groove-like connection socket are provided extending at least substantially entirely along a respective one of the fixing member or retaining member.

10. A fixing system as claimed in claim 9, wherein the plug and socket each have one or more cooperable retaining ribs and grooves extending therealong to retain the connection plug in the connection socket.

11. A fixing system as claimed in claim 10, wherein the connection plug is located on the retaining member and projects downwardly from a lower surface thereof, and the connection socket is located in the fixing member and opens upwardly onto a top surface thereof.

12. An ore screening apparatus comprising: a screen deck frame having a sub-frame structure; an array of screen panels on the screen deck frame to form a continuous screen deck, each screen panel having an upper screening surface and a pair of opposed side edge regions with an upwardly facing bearing face formed along each side edge region beneath tile upper screening surface; and, a fixing system fixing the screen panels to the screen deck frame, the fixing system having elongate fixing members arranged on the sub-frame structure in parallel spaced apart rows so as to extend along and between the side edge regions of respective pairs of adjacent screen panels, the fixing members non-interconnecting with the screen panels, and elongate retaining members extending along and connecting with the fixing members, each retaining member including a locating portion positioned between a respective pair of adjacent screen panels beneath the upper screening surfaces thereof, the locating portion having a pair of downwardly facing retaining faces extending therealong, each said retaining face being in downward bearing engagement with a respective one of the upwardly facing bearing faces, and a cover portion positioned above a respective pair of adjacent screen panels, the cover portion having another pair of downwardly facing retaining faces extending therealong, each said other retaining face being in downward bearing engagement with a respective one of the upper screening surfaces of the adjacent screen panels, whereby the retaining members secure the screen panels in position against upward movement away from the screen deck frame.

13. An ore screening apparatus as claimed in claim 12, wherein the side edge regions of adjacent screen panels have opposed flat and planar side edge face, and the fixing members each include a fixing rail of generally square or rectangular cross-sectional profile, each fixing rail having a pair of longitudinally extending side edge faces, the side edge faces of each fixing rail being wholly flat and extending in face-to-face, non-interconnecting relation with the respective side edge faces of the adjacent screen panels.

14. An ore screening apparatus as claimed in claim 13, wherein each retaining member includes a retaining strip, the retaining strip being laterally stepped between the pairs of retaining faces with the retaining faces on the cover portion being located laterally outwardly of and above the retaining faces on the locating portion.

15. An ore screening apparatus as claimed in claim 14, wherein each fixing rail is sized so that the top surface thereof is located below the upper screening surface of the adjacent screen panels, whereby a locating channel is defined above each fixing rail and between respective adjacent screen panels, and each retaining strip is received in a respective locating channel.

16. An ore screening apparatus as claimed in claim 15, wherein each fixing rail comprises a groove-like connection socket extending entirely therealong and opening upwardly on to a top surface thereof, and each retaining strip comprises a rib-like connection plug extending entirely along the locating portion and projecting downwardly from a lower surface thereof into the connection socket thereby to secure each retaining strip to the respective fixing rail, and fix the screen panels to the screen deck frame.

* * * * *

UNITED STATES PATENT AND TRADEMARK OFFICE

CERTIFICATE OF CORRECTION

PATENT NO. : 5,769,241

DATED : JUNE 23, 1998

INVENTOR(S) : WOODGATE

It is certified that error appears in the above-identified patent and that said Letters Patent is hereby corrected as shown below:

Column 2, line 8, delete "–" between "a" and "fixing".

Column 2, line 57, change "Screen" to —screen—.

Column 4, line 25, change "M1" to —M—.

Column 4, line 65, change "Shown" to —shown—.

Column 5, line 17, change "S" to —5—.

Column 5, line 40, "!screen" should be —screen—.

Column 6, line 32, change "B" to —8—.

Column 7, line 41, change "surfacer:" to —surfaces—.

UNITED STATES PATENT AND TRADEMARK OFFICE

CERTIFICATE OF CORRECTION

PATENT NO. : 5,769,241

DATED : JUNE 23, 1998

INVENTOR(S) : WOODGATE

It is certified that error appears in the above-identified patent and that said Letters Patent is hereby corrected as shown below:

Column 9, line 32, change "one)" to --one--.

Column 9, line 55, change "tile" to --the--.

Column 10, line 25, change "face" to --faces--.

Signed and Sealed this

Fourth Day of May, 1999

*Attest:*

*Attesting Officer*

Q. TODD DICKINSON

*Acting Commissioner of Patents and Trademarks*